United States Patent [19]

Grau et al.

[11] Patent Number: 5,035,027

[45] Date of Patent: Jul. 30, 1991

[54] MEANS FOR MANIPULATING A DRAFTING ROLLER CARRIER OF A TEXTILE MACHINE

[75] Inventors: Gerhard Grau, Muellheim; Rudolf Wieland, Filderstadt, both of Fed. Rep. of Germany

[73] Assignees: Zinser Textilmaschinen GmbH, Ebersbach/Fils; Spindelfabrik Susen, Schurr, Stahlecker & Grill, Sussen, both of Fed. Rep. of Germany

[21] Appl. No.: 478,353

[22] Filed: Feb. 12, 1990

[30] Foreign Application Priority Data

Feb. 11, 1989 [DE] Fed. Rep. of Germany ..... 3904108

[51] Int. Cl.[5] ..... D01H 5/46

[52] U.S. Cl. ..... 19/258

[58] Field of Search ..... 19/258, 266, 267

[56] References Cited

U.S. PATENT DOCUMENTS

| | | | |
|---|---|---|---|
| 2,724,149 | 11/1955 | Noguera | 19/267 |
| 2,958,103 | 11/1960 | Schrotz | 19/266 |
| 3,007,210 | 11/1961 | Lattion | 19/267 |
| 3,078,520 | 2/1963 | Stahlecker | 19/267 |
| 3,191,237 | 7/1965 | Takita | 19/267 |
| 3,200,446 | 8/1965 | Dausch | 19/267 |
| 3,310,848 | 3/1967 | Stahlecker et al. | 19/267 |
| 3,609,820 | 10/1971 | Kohloch | 19/267 |
| 3,748,694 | 7/1973 | Staneff | 19/258 |
| 4,878,268 | 11/1989 | Mirabet et al. | 19/258 |

FOREIGN PATENT DOCUMENTS

| | | | |
|---|---|---|---|
| 2504309 | 10/1975 | Fed. Rep. of Germany | 19/266 |
| 374312 | 2/1964 | Switzerland | 19/267 |
| 358439 | 6/1969 | U.S.S.R. | 19/267 |
| 732939 | 5/1954 | United Kingdom | 19/258 |
| 1275419 | 5/1972 | United Kingdom | 19/267 |

*Primary Examiner*—Werner H. Schroeder
*Assistant Examiner*—John J. Calvers
*Attorney, Agent, or Firm*—Shefte, Pinckney & Sawyer

[57] ABSTRACT

An apparatus for manipulating the drafting roller carrier of a textile machine includes a handle for selectively maintaining the drafting roller carrier in an operative position in which the upper drafting rollers on the carrier are in nip engagement with the lower drafting rollers. The apparatus additionally includes an assembly for interconnecting the handle and the carrier for selected coordinated movement of the carrier and the handle upon manipulation of the handle between a handle operating position and a raised position. An operating stop device and a raised position stop device each include a concave surface and the handle includes a nesting member compatibly configured with the concave surfces to nest therein to prevent movement of the carrier from its respective operating or raised position. The nesting member is movably received in the slot of a slot device pivotally connected to the frame for constraining the nesting member to move along a predetermined travel path during manipulation of the handle between its operating and raised positions.

3 Claims, 4 Drawing Sheets

MEANS FOR MANIPULATING A DRAFTING ROLLER CARRIER OF A TEXTILE MACHINE

BACKGROUND OF THE INVENTION

The present invention relates to means for manipulating a drafting roller carrier of a textile machine.

The drafting apparatus of a drafting frame or a roving frame or other similar textile processing machines, typically includes a plurality of associated pairs of rollers, each roller pair having an upper roller and a lower roller. The lower rollers are usually mounted on the frame and the upper rollers are mounted on a carrier generally pivotally mounted at one end on a pivot shaft for pivoting between an operating position in which the upper rollers are cooperatively disposed with respect to their associated lower rollers to form nips therebetween for the feed of the textile material through the nips and a raised or non-operating position in which the upper rollers are supported at a spacing upwardly from their respective associated lower rollers.

To releasably maintain the carrier in its operating position, the drafting apparatus typically includes a force-applying handle extending over the top of the carrier and engaging the carrier to apply a downward roller nip pressure. To move the carrier to its non-operating or raised position, the force-applying handle is manipulated to a raised position and the carrier is interconnected to the handle so that raising of the handle effects raising of the carrier. This is disclosed, for example, in German Patent 1 233 755 in which the apparatus is configured such that an operator can with one manipulation raise both the handle and the carrier from their operating positions to raised positions in which the handle and the carrier are releasably maintained. However, the handle is maintained in the raised position by a spring latch engaging a latch pin, which requires disengagement of the pin from the spring latch before the handle and carrier can be lowered to their operating positions. Thus, an involved manipulation is necessary to lower the handle and carrier.

However, the need exists for means which manipulates the handle and associated drafting roller carrier between their respective operating and non-operating or raised positions in a simple, efficient and reliable manner.

SUMMARY OF THE INVENTION

The present invention provides means for moving the force-applying handle and its associated drafting roller carrier of a textile machine between their respective operating and non-operating or raised positions simply, efficiently and reliably.

Briefly described, the present invention provides means for manipulating the carrier of a textile machine of the type having a frame and a drafting apparatus, the drafting apparatus having a plurality of lower drafting rollers and a plurality of upper drafting rollers forming a plurality of nip locations with the lower drafting rollers, the upper drafting rollers being rotatably supported on the carrier which is pivotally mounted to the frame of the textile machine and pivotable in a release direction from an operating position in which the upper drafting rollers are in nip engagement with the lower drafting rollers to a raised position in which the upper drafting rollers are out of nip engagement for servicing of the drafting apparatus and pivotable in a closing direction from the raised position to the operating position. The means for manipulating the carrier include a handle normally engaging the carrier in a handle operating position to maintain the upper drafting rollers in nip engagement with the lower drafting rollers, the handle being manipulable between its operating position and a raised position, means interconnecting the handle and the carrier for selected coordinated movement of the carrier and the handle upon manipulation of the handle between the handle operating position and a raised position, operating stop means and raised position stop means.

The operating stop means, connected to the frame, is for engagement by the handle when the handle is in the handle operating position to prevent pivoting of the carrier in the release direction. The raised position stop means, connected to the frame, is for engagement by the handle when the handle is in its raised position to prevent pivoting of the carrier in the closing direction. The interconnecting means includes means permitting manipulation of the handle away from the raised position stop means and maintaining the handle out of engagement with the raised position stop means upon manipulation of the handle from the raised position to the operation position.

In the preferred embodiment, the operating stop means includes a concave surface, the raised position stop means includes a concave surface and the handle includes a member compatibly configured to nest within the concave surface of the operating stop means when the handle is in the handle operating position for resisting relative movement between the handle and the frame to prevent movement of the carrier from its operating position, and to nest within the concave surface of the raised position stop means when the handle is in the handle raised position for resisting relative movement between the handle and the frame when the handle is in its raised position to prevent of the carrier from its raised position. The interconnecting means includes linkage means, connected to the frame and the handle, for confining movement of the handle along a predetermined travel path between its operating and raised positions, the linkage means including slot means pivotally connected to the frame and having a slot, the member being movably received within the slot.

DETAILED DESCRIPTION OF THE PREFERRED EMBODIMENT

Figure 2:
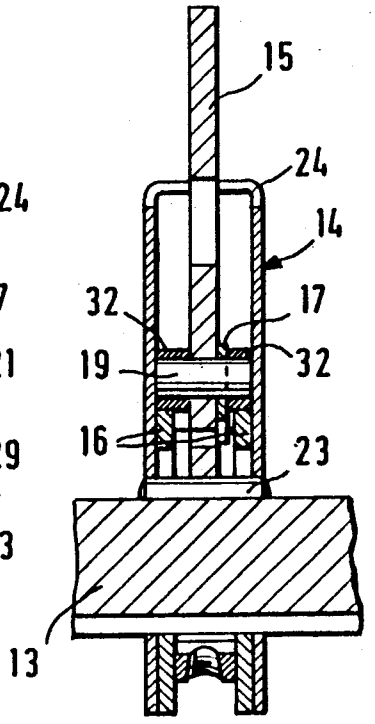
FIG. 2 is a vertical sectional view, taken along lines II—II, of FIG. 1.

In FIGS. 1–5, a textile drafting apparatus of a textile machine is illustrated which incorporates the preferred embodiment of the carrier manipulating apparatus of the present invention. The textile drafting apparatus is of the type for drafting a strand of textile material such as, for example, roving or yarn, and includes a conventional carrier 14 pivotally mounted on a shaft 13 extending along the length of the textile machine for pivoting of the carrier 14 generally transverse to the direction of travel of the textile material through the drafting apparatus.

The carrier 14 includes an elongate portion 26 having a generally flat top surface and an end mounting portion. A plurality of upper drafting rollers 10,11 and 12 are each adjustably fixedly supported on the elongate portion 26 by conventional brackets and the upper drafting rollers 10–12 each cooperate with a respective one of a plurality of lower drafting rollers (not shown) to define therebetween a roller nip through which the textile strand travels during the drafting operation.

The textile drafting apparatus also includes a handle 15 pivotally connected by a pivot pin 23 to the end mounting portion 25 of the carrier 14 for pivoting about an axis parallel to the shaft 13. The handle 15 includes an end portion 29 through which the pivot pin 23 is rotatably mounted, a free end portion 30 and an interconnecting portion 28 interconnecting the end portion 29 and the free end portion 30. The free end portion 30 includes a conventional handle grip for convenient engagement of the handle 15 by an operator. The handle 15 is mounted generally centrally laterally over the top of the carrier 14 and the end portion 29 is received in a vertical slot 24 formed on the carrier 14 rearwardly of the elongate portion 26 thereof. The handle 15 additionally includes a planar force applying surface 31 adapted to engage the generally flat top surface of the elongate portion 26 of the carrier 14 to apply a downward roller nip force through the carrier 14 to the upper rollers 10–12. The handle 15 can be formed in conventional manner from plate steel.

Figure 1:
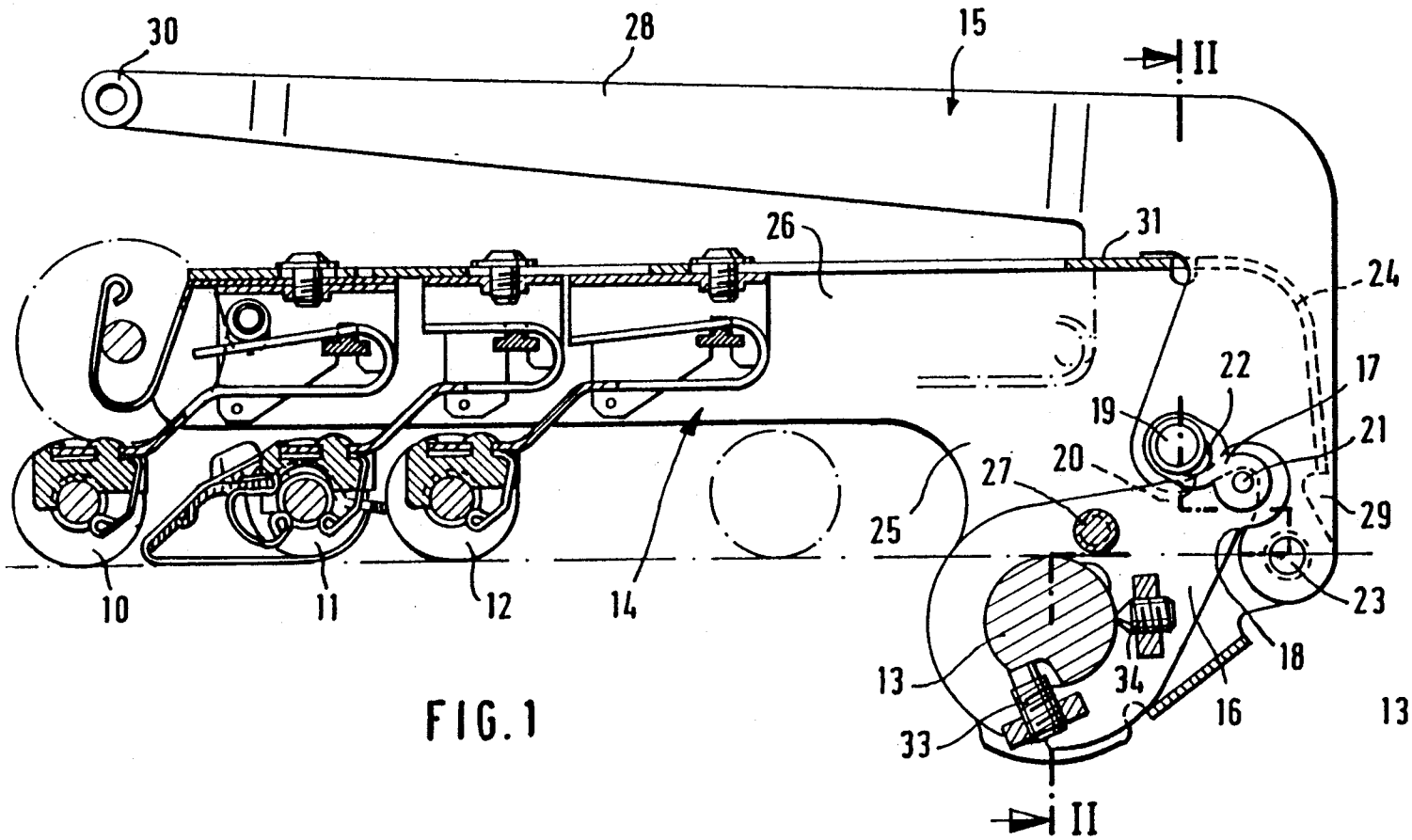
FIG. 1 is a side elevational view, in partial section, of a textile drafting apparatus which incorporates the preferred embodiment of the manipulating means of the present invention, showing the carrier and handle of the textile drafting apparatus in their respective operating positions.

As best seen in FIG. 2, the handle 15 includes a cylindrical pin 19 extending laterally to each side of the handle. A pair of hollow cylindrical spacers 32 are each rotatably mounted on a respective lateral side of the cylindrical pin 19. A pair of identical stop plates 16 are connected to one another in spaced, parallel relation by a transverse bolt 27, shown in FIG. 1, and are adjustably fixedly mounted to the shaft 13 by a pair of stop bolt assemblies 33,34. The stop bolt assembly 33 includes a bolt threadably mounted to a plate which extends transversely between the stop plate 16 and is fixedly connected thereto. The stop bolt assembly 34 includes a bolt threadably mounted to the stop plates 16. As seen in FIG. 1, the adjustment bolt of the stop bolt assembly 33 engages an axially extending recess in the shaft 13 and the bolt of the stop bolt assembly 34 engages the shaft 13 at a location circumferentially spaced from the axially extending shaft recess to adjustably fixedly mount the stop plates 16 to the shaft 13.

A linkage means includes a slot plate 17 pivotally connected by a pivot pin 21 to one of the stop plates 16 and having a slot 22 extending radially with respect to the axis of the pivot pin 21. The transverse dimension of the slot 22 is slightly greater than the diameter of the pin 19 but of a smaller extent than the outer diameter of the spacers 32. The slot plate 17 is disposed between one of the spacers 32 and the rear portion 29 of the handle 15 and the pin 19 is rotatably received within the slot 22.

The stop plates 16 form an operating stop means and a raised position stop means. The operating stop means includes an upwardly facing concave surface 20 inclined downwardly and forwardly with respect to the direction of feed of the yarn through the roller nips. The raised position stop means includes a downwardly facing concave surface 18 inclined downwardly and forwardly with respect to the direction of travel of yarn through the roller nips and spaced rearwardly and downwardly from the concave surface 20 of the operating stop means with the pivot pin 21 mounted between the concave surfaces 18,20.

The concave surface 20 of the operating stop means projects behind the pin 19 in the path of pivoting of the pin 19 about the shaft 13 when the handle is at rest on the carrier so that any attempted raising of the carrier without positive manipulation of the handle would be prevented by the surface obstructing movement of the pin 19; but the inclination of the extent of the surface 20 is limited so as not to interfere with pivoting of the pin 19 about the pivot connection pin 23 when the handle itself is manipulated upwardly.

Similarly, the concave surface 18 of the raised position stop means projects in front of and over the pin 19 in the path of pivoting of the pin 19 about the shaft 13 when the handle and carrier are in their raised positions so that the handle and carrier will be maintained in their raised positions; but the inclination of the extent of this surface 28 is sufficient to not interfere with rearward pivoting of the pin 19 about the pivot connection pin 23 when the handle is manipulated rearwardly from its raised position to disengage the pin 19 from the surface so that the handle and carrier can be lowered to their operating positions.

The aforementioned slot plate 17 and pin 21 connection interconnects the handle and carrier so that manipulating of the handle can effect, through the pin 19 and slot plate 17, manipulation of the carrier, with the slot 22 providing sufficient lost motion in the connection to permit disengagement of the pin 19 from the stop surfaces 18,20 before the carrier is manipulated and to guide the pin 19 around the stop plate 16 from surface to surface as the handle is manipulated between its operating and raised positions.

The operation of the carrier 14 and the handle 15 is as follows. As seen in FIG. 1, the carrier 14 is positionable in an operating position in which the upper drafting rollers 10–12 are in nip engagement with the lower drafting rollers. The handle 15 is in an operating position in which the force applying surface 31 is in contact with the top surface of the carrier 14 and the intermediate portion 28 of the handle 15 extends generally longitudinally over the center of the carrier 14. In the operating position of the handle 15, the pin 19 is in engagement with the concave surface 20 of the operating stop means with the surface resisting movement of the pin 19 and thereby obstructing pivoting of the carrier 14 about the shaft 13. As seen in FIG. 1, the axes of the pin 19, the pivot pin 21 and the pivot pin 23 generally lie in a common plane.

Figure 3:
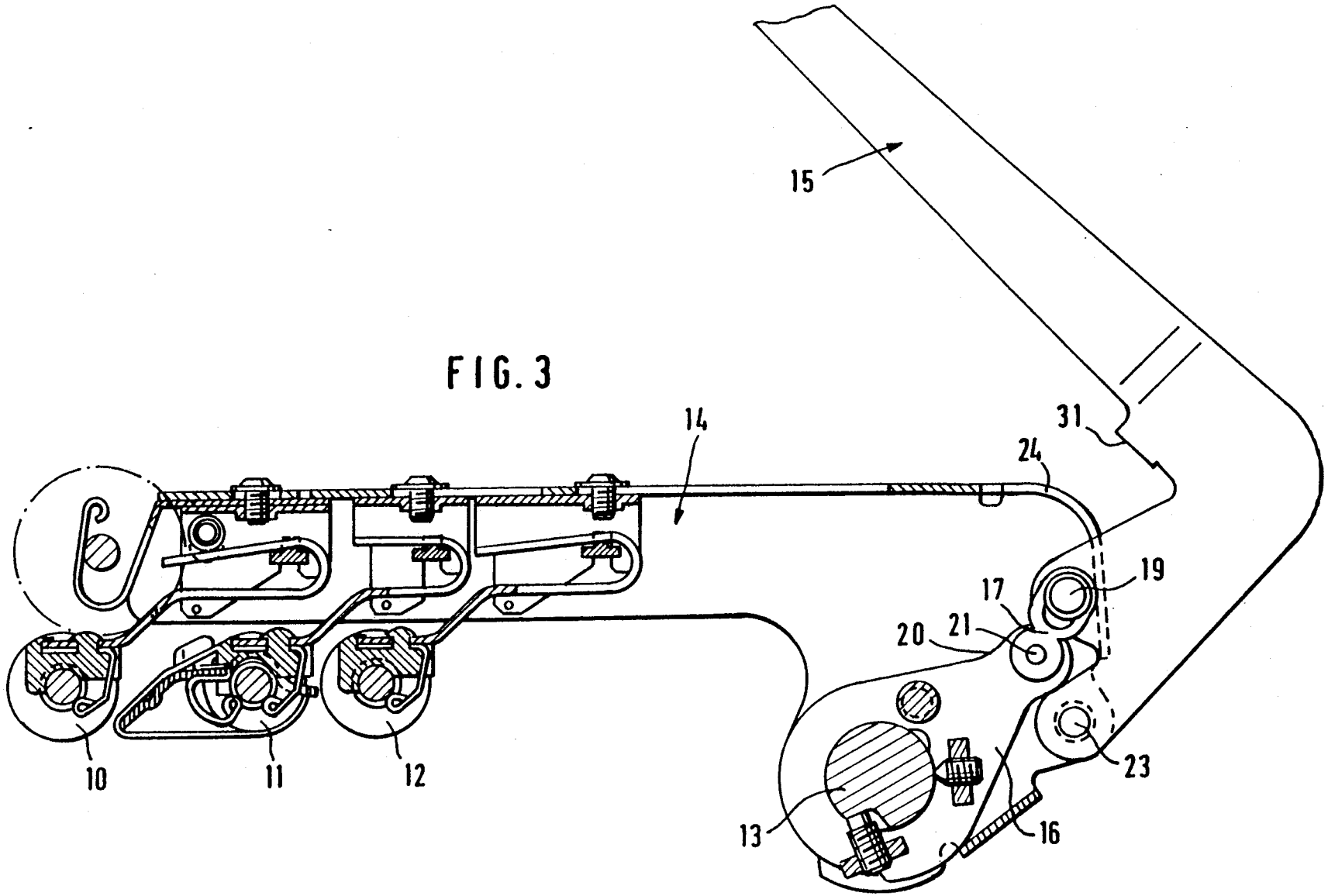
FIG. 3 is a side elevational view, in partial section, of the textile drafting apparatus shown in FIG. 1, showing the handle of the textile drafting apparatus in its position immediately after the handle has cleared the operating stop means of the textile drafting apparatus.

When an operator desires to perform a servicing operation on the drafting apparatus, or otherwise wishes to raise the carrier, the operator engages the grip of the handle 15 and manipulates the handle 15 to pivot about the pivot pin 23 in a clockwise direction as viewed in FIG. 1. The pivoting movement of the handle 15 moves the force applying surface 31 of the handle out of contact with the top surface of the carrier 14 as the rear portion 29 of the handle 15 moves relative to the slot 24 of the carrier 14. As seen in FIG. 3, the slot 22 permits the pin 19 to move radially outwardly along the slot 22 with respect to the axis of the pivot pin 21 to permit the pin 19 to clear the surface 20 of the operating stop means. Once the pin 19 has moved fully radially outwardly along the slot 22, the slot plate 17 constrains the pin 19 to move along a travel path within an arcuate band, concentric with respect to the pivot pin 21 and having a radial dimension defined by the length of the slot 22, during further movement of the handle 15 in a clockwise direction about the pivot pin 23.

Figure 4:
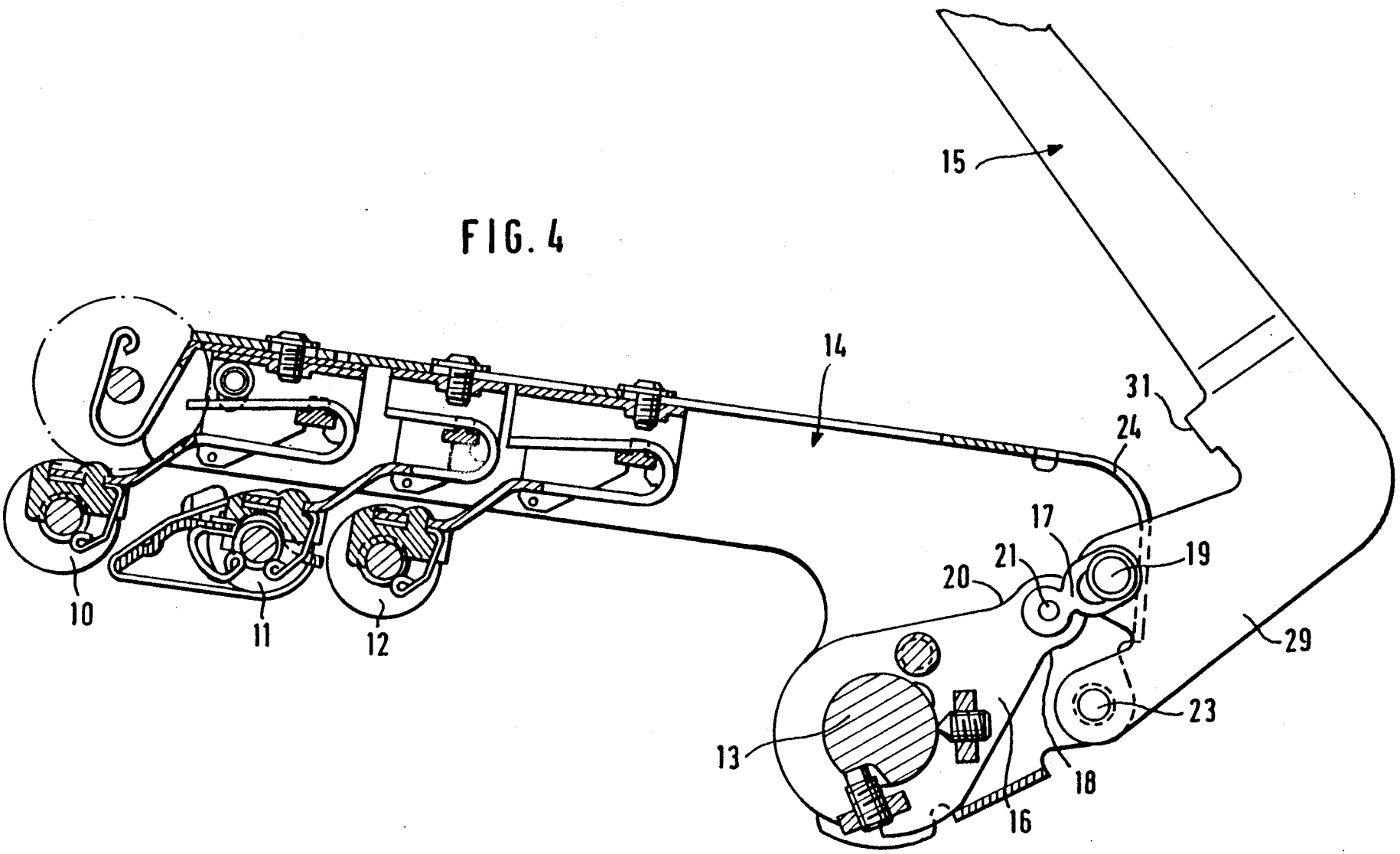
FIG. 4 is a side elevational view, in partial section, of the textile drafting apparatus shown in FIG. 1, showing the position of the handle and the carrier of the textile drafting apparatus shortly after the carrier has begun movement from its operating position to its raised position.
Figure 5:
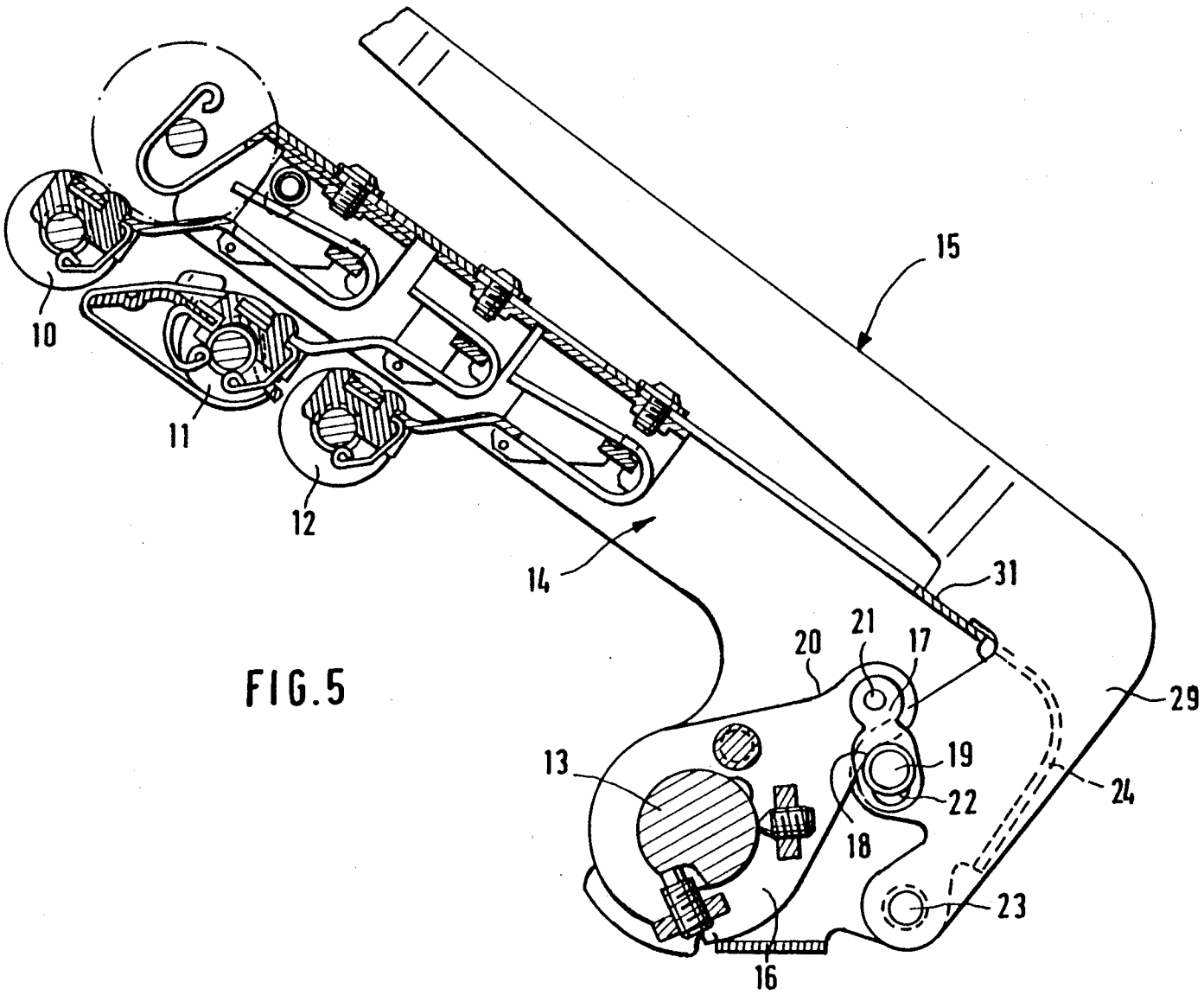
FIG. 5 is a side elevational view, in partial section, of the textile drafting apparatus shown in FIG. 1, showing the carrier and handle in their respective raised positions with the handle in releasable engagement with the raised position stop means of the textile machine.

As seen in FIG. 4, continued clockwise movement of the handle 15 about the pivot pin 23 after the pin 19 has moved fully radially outwardly along the slot 22 produces coordinated movement of the carrier 14 with the handle 15 toward the raised positions. Specifically, as seen in FIG. 4, the carrier 14 pivots in a clockwise direction about the shaft 13 due to the force applied by the handle 15 against the pivot pin 23. Eventually, the coordinated movement of the handle 15 and carrier 14 results in a relative disposition between the carrier 14 and the stop plates 16 such that the spacing of the pivot pin 23 and the pivot pin 21 is sufficient to permit movement of the pin 19 therebetween, through manipulation of the handle 15, into engagement with the surface 18 of the raised position stop means. In this regard, the handle 15 is manipulated to cause the pin 19 to move radially inwardly along the slot 22 toward the pivot pin 21 and the handle is manipulated such that the force applying surface 31 is brought into engagement with the top surface of the carrier 14, which is now in a raised position in which the upper drafting rollers 10–12 are spaced out of nip engagement with the lower drafting rollers.

The surface 18 of the raised position stop means is dimensioned with respect to the pin 19 and the pivot pins 21,23, when the force applying surface 31 of the handle 15 is in engagement with the top surface of the carrier 14 so that the pin 19 will be prevented from moving out of engagement with the surface 18 when the handle is not manipulated from its raised position.

In this regard, the weight of the carrier 14 produces a counterclockwise pivoting of the carrier 14 about the shaft 13 which causes the pivot pin 23 to apply an upwardly directed force to the rear portion 29 of the handle 15 which results in the pin 19 being urged against the surface 18 of the raised position stop means. Accordingly, the carrier 14 and the handle 15 are maintained in their respective raised positions once the handle has been manipulated to bring the pivot pin 19 into raised stop means engagement.

To move the carrier 14 and the handle 15 from their respective raised positions, the handle 15 is manipulated to move the pin 19 out of engagement with the surface 18 of the raised position stop means. In this regard, the slot plate 17 pivots about the pivot pin 21 to guide the pin 19 out of engagement with the surface 18 during initial movement of the pin 19 from its surface engaging position. During this initial movement of the pin 19, the pin moves radially outwardly along the slot 22 with respect to the pivot pin 21 and the slot plate 17 guides the pin along a travel path concentric with respect to the pivot pin 21. This movement of the handle 15 allows the carrier 14 to pivot downwardly, constrained by the pin 19 and slot 22 connection, in coordination with downward manipulation of the handle until the carrier 14 is returned into its operating position in which the upper drafting rollers 10-12 are in nip engagement with the lower drafting rollers. The operator then continues to manipulate the handle 15 to its operating position, during which movement the pin 19 is moved into engagement with the surface 20 of the operating stop mean to maintain the carrier 14 in its operating position.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a frame and a drafting apparatus, the drafting apparatus having a plurality of lower drafting rollers, a plurality of upper drafting rollers, and a carrier for supporting the upper drafting rollers in respective nip arrangements with the lower drafting rollers, the carrier being pivotally mounted to the frame of the textile machine for pivotal movement in an opening direction from a carrier operating position in which the upper drafting rollers are in nip engagement with the lower drafting rollers to a carrier raised position in which the upper drafting rollers are out of nip engagement for servicing of the drafting apparatus and a closing direction opposite to the opening direction from the carrier raised position to the carrier operating position, means for manipulating the carrier between the carrier operator position and the carrier raised position, comprising:

a handle operable to engage the carrier in a nip maintaining position in which the carrier is maintained in the carrier operating position in which the upper drafting rollers are in nip engagement with the lower drafting rollers, said handle being movable between said nip maintaining position and a nip release position and said handle moving the carrier from the carrier operating position to the carrier raised position during movement of said handle from said nip maintaining position to said nip release position;

means interconnecting said handle and the carrier for selected coordinated movement of the carrier and said handle to thereby permit said handle to effect positioning the carrier in the carrier operating and the carrier raised positions, said interconnecting means including slot means having a slot and slot engaging means, said slot means being movably connected to the frame of the textile machine and said slot engaging means being connected to said handle and being movably received in said slot, said interconnecting means interconnecting said handle and the carrier such that said slot engaging means moves in correspondence with the pivoting of the carrier in the opening direction when a nip releasing force is applied through the upper drafting rollers to the carrier and such that said slot engaging means moves in correspondence with the pivoting of the carrier in the closing direction when a closing force is applied against the carrier;

operating stop means for preventing pivoting of the carrier in the opening direction out of nip engagement when said handle is in said nip maintaining position, said operating stop means including a concave surface formed on the frame of the textile machine, said slot engaging means being compatibly configured with said concave surface of said operating stop means for nesting engagement therewith and said concave surface being disposed relative to the path of movement of said slot engaging means during movement thereof in correspondence with the pivoting of the carrier in the opening direction to effect nesting engagement of said slot engaging means therewith and thereby prevent further pivoting of the carrier against the nip maintaining force applied by said handle in said nip maintaining position; and raised position stop means for preventing pivoting of the carrier in the closing direction when said handle is in said nip release position, said raised position stop means including a concave surface formed on the frame of the textile machine, said slot engaging means being compatibly configured with said concave surface of said raised position stop means for nesting engagement therewith and said concave surface being disposed relative to the path of movement of said slot engaging means during pivoting of the carrier in the closing direction to effect nesting engagement of said slot engaging means therewith and thereby prevent further pivoting of the carrier in the closing direction against the force applied by said handle in said nip release position, said interconnecting means permitting limited movement of said slot engaging means in said slot as said slot engaging means moves in correspondence with movement of said handle in the opening direction, the limited movement being sufficient for said slot engaging means to move out of nesting engagement with said operating stop means to thereby permit said handle to effect movement of the carrier from the carrier operating position to the carrier raised position and said interconnecting means permitting limited movement of said slot engaging means in said slot as said slot engaging means moves in correspondence with movement of said handle during movement of said handle in the closing direction, the limited movement being sufficient for said slot engaging means to move out of nesting engagement with said raised position stop means to thereby permit said handle to effect movement of the carrier from the carrier raised position to the carrier operating position.

2. In a textile machine, the carrier manipulating means according to claim 1 and further comprising said slot means is pivotally mounted to the frame of the textile machine for pivoting about an axis and said slot extends generally radially with respect to the axis of pivoting of said slot means.

3. In a textile machine, the carrier manipulating means according to claim 1 and further comprising said interconnecting means includes a pin member movably mounted to said handle and the carrier movably interconnecting said handle and the carrier.

* * * * *